US012685379B2

(12) United States Patent
Pasciolla

(10) Patent No.: US 12,685,379 B2
(45) Date of Patent: Jul. 21, 2026

(54) REFILLABLE COSMETIC PRODUCT

(71) Applicant: ELC MANAGEMENT LLC, Melville, NY (US)

(72) Inventor: Tobias Paul Pasciolla, Cliffside Park, NJ (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 18/618,202

(22) Filed: Mar. 27, 2024

(65) Prior Publication Data

US 2025/0302178 A1 Oct. 2, 2025

(51) Int. Cl.

| | |
|---|---|
| ***A45D 33/00*** | (2006.01) |
| ***A45D 34/00*** | (2006.01) |
| ***A45D 40/00*** | (2006.01) |
| ***B65D 43/02*** | (2006.01) |
| ***B65D 77/04*** | (2006.01) |

(52) U.S. Cl.

CPC ..... *A45D 40/00* (2013.01); *A45D 34/00* (2013.01); *B65D 43/0231* (2013.01); *B65D 77/0493* (2013.01); *A45D 2200/05* (2013.01); *B65D 2543/00092* (2013.01); *B65D 2543/00537* (2013.01)

(58) Field of Classification Search

CPC .... A45D 40/00; A45D 34/00; A45D 43/0231; A45D 77/0493; A45D 2200/05; A45D 2543/00092; A45D 2543/00537; A45D 40/22; A45D 33/006; A45D 40/24; A45D 40/0068; A45D 2040/0062; A45D 33/24; A45D 33/003

USPC ..... 206/823, 581, 229, 37

See application file for complete search history.

(56) References Cited

U.S. PATENT DOCUMENTS 7,451,877 B2 * 11/2008 Koga ..... B65D 43/0231 206/581
7,819,125 B2 * 10/2010 Maelstaf ..... A45D 33/006 132/294
2020/0275759 A1 9/2020 Chevalier
2021/0169198 A1 * 6/2021 Moretti ..... A45D 40/24

(Continued)

FOREIGN PATENT DOCUMENTS

CN 115892720 A 4/2023

OTHER PUBLICATIONS

Taiwan Patent Application No. 112130213, Office Action and Search Report, dated Jul. 11, 2025.

(Continued)

*Primary Examiner* — King M Chu

(74) *Attorney, Agent, or Firm* — MARSHALL, GERSTEIN & BORUN LLP

(57) ABSTRACT

A cosmetic product may include an outer housing having a rim forming an opening and including an interior cavity, a container coupling member operably coupled with the rim of the outer housing, and a removable container the container including an outer surface and a container cavity adapted to retain a cosmetic substance. The container coupling member includes a ring member defining an interior surface. The removable container may be insertable into the interior cavity of the outer housing such that the interior surface of the ring member frictionally engages the outer surface of the removable container to retain the removable container therewithin.

17 Claims, 5 Drawing Sheets

(56) References Cited

U.S. PATENT DOCUMENTS

| | | | |
|---|---|---|---|
| 2021/0298451 | A1 | 9/2021 | Coquard |
| 2023/0107932 | A1 | 4/2023 | Coquard et al. |

OTHER PUBLICATIONS

Bobbi Brown Professional Cosmetics, Inc., "Bobbi Brown Vitamin Enriched Face Base Hydrating Primer". Retrieved from the Internet on Mar. 27, 2027: <URL: https://www.bobbibrowncosmetics.com/product/14007/7485/skincare/moisturizer/vitamin-enriched-face-base-moisturizer-primer/vefb>.

Chanel, N°1 De Chanel Revitalizing Cream. Retrieved from the Internet on Mar. 27, 2024: <URL: https://www.chanel.com/us/skincare/p/140740/n1-de-chanel-revitalizing-cream-smooths-plumps-provides-comfort/>.

Chanel, Sublimage La Créme Texture Supréme. Retrieved from the Internet on Mar. 27, 2024: <URL: https://www.chanel.com/us/skincare/p/147560/sublimage-la-creme-texture-supreme-ultimate-cream/>.

Estee Lauder Inc, "Re-Nutriv Ultimate Diamond Sculpted Transformation Creme Moisturizer". Retrieved from the Internet on Mar. 27, 2024: <URL: https://www.esteelauder.com/product/677/105505/product-catalog/re-nutriv/re-nutriv-moisturizer/re-nutriv/ultimate-diamond-sculpted-transformation-creme-moisturizer>.

* cited by examiner

REFILLABLE COSMETIC PRODUCT

FIELD OF THE DISCLOSURE

The present disclosure generally relates to cosmetic products and, more particularly, to cosmetic products having refillable features.

BACKGROUND

Containers and storage receptacles for cosmetic products and/or substances may be provided in a number of different arrangements and configurations. For example, containers may be used to retain a cosmetic substance in the form of a moisturizing cream or serum product. These containers may include a removable and/or a rotatable (e.g., a flip-up) top or lid to allow a user to access and use the cosmetic substance contained therein. Oftentimes, such existing containers are in the form of a unitary, disposable shell to provide for stability during manufacturing as well as during shipment. However, such arrangements may not be reusable, and as a result may lead to unwanted waste. In other examples, products may be provided with refillable containers. Such containers typically include secondary components secured with the refillable container and/or require additional steps to remove and replace the container. Such a removal and/or installation process may not only be time consuming for the user, which may result in an unpleasant use experience, but may also result in additional manufacturing and material costs due to the need for additional components.

Accordingly, there is a need for improved products having improved functionalities.

SUMMARY

Examples within the scope of the present disclosure are directed to the use of a cosmetic product having ergonomic and replaceable features. A cosmetic product may include an outer housing having a rim forming an opening and including an interior cavity, a container coupling member operably coupled with the rim of the outer housing, and a removable container the container including an outer surface and a container cavity adapted to retain a cosmetic substance. The container coupling member includes a ring member defining an interior surface. The removable container may be insertable into the interior cavity of the outer housing such that the interior surface of the ring member frictionally engages the outer surface of the removable container to retain the removable container therewithin.

In some aspects, the ring member is at least partially constructed from a resilient material. In some examples, the ring member includes at least one inwardly-directed support segment. In these and other examples, the ring member includes a first member including a ledge and a second member operably coupled therewith, wherein the at least one inwardly-directed support segment is formed on the second member.

In some aspects, the removable container includes a flange adapted to rest on the ledge of the first member of the ring member. The first member may further include an exterior threaded region. Further, in some approaches, the rim of the outer housing defines a ledge dimensioned to accommodate a lower portion of the first member, thereby operably coupling the container coupling member therewith.

In some approaches, each of the first member and the second member forms a generally annular shape.

In these and other examples, the first member may be constructed from at least one of polyethylene terephthalate glycol, polyketone, or polypropylene. Further, in some examples, the second member is constructed from at least one of polypropylene, polyketone, or polyethylene.

In some forms, the cosmetic product may further include a lid member adapted to cover the container cavity.

In accordance with a second aspect, the techniques described herein relate to a cosmetic product including: an outer housing having a rim forming an opening, the outer housing including an interior cavity; a container coupling member operably coupled with the rim of the outer housing, the container coupling member including a ring member defining an interior dimension; and a removable container including an outer surface and a container cavity adapted to retain a cosmetic substance, the outer surface defining an exterior dimension that is greater than the interior dimension of the ring member; wherein the removable container is insertable into the interior cavity of the outer housing such that the ring member frictionally engages the outer surface of the removable container to retain the removable container therewithin.

In accordance with a third aspect, the techniques described herein relate to a cosmetic product including: an outer housing having a rim forming an opening, the outer housing including an interior cavity; a container coupling member operably coupled with the rim of the outer housing, the container coupling member including a ring member defining an interior surface, the ring member including at least one inwardly-directed support segment adapted to frictionally engage a removable container upon inserting the removable container therewithin.

BRIEF DESCRIPTION OF THE DRAWINGS

The above needs are at least partially met through provision of one, more than one, or any combination of the refillable cosmetic products described in the following detailed description, particularly when studied in conjunction with the drawings, wherein.

Figure 1:
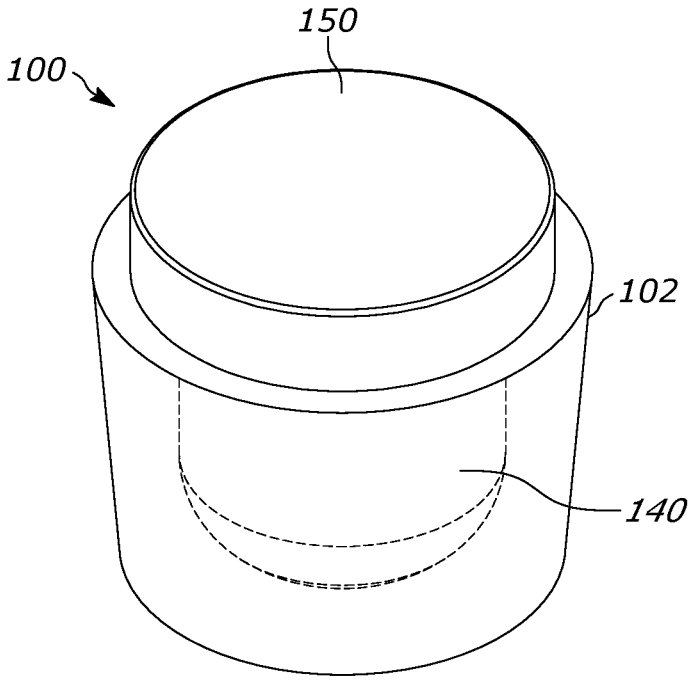
FIG. 1 illustrates a perspective view of an example cosmetic product in accordance with various examples.
Figure 2:
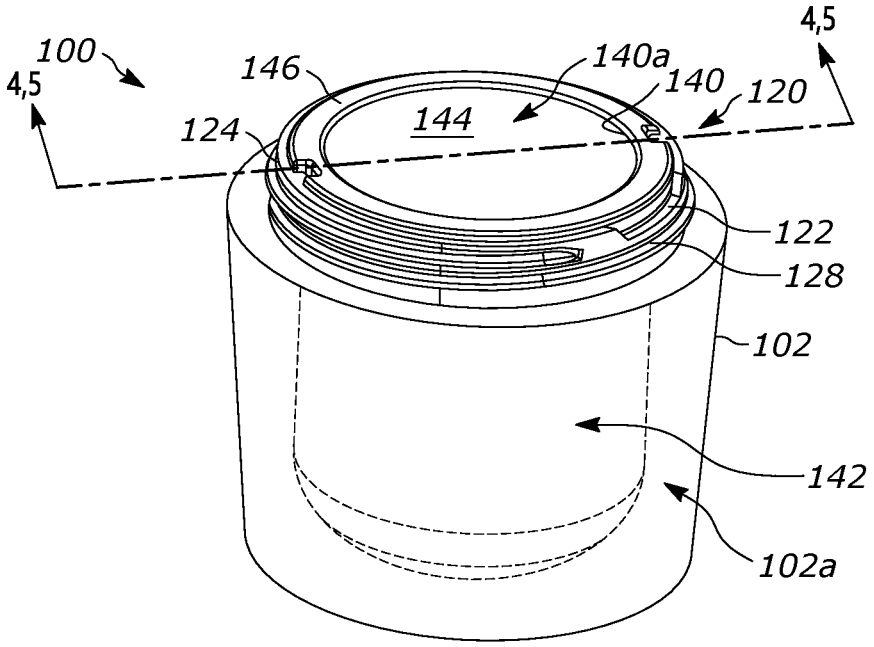
FIG. 2 illustrates a perspective view of the example cosmetic product of FIG. 1 having an example lid removed therefrom in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, cosmetic product containers are provided that incorporate removable and refillable containers (e.g., bottles, jars, etc.) that may be replaced with minimal steps and effort. The present system allows refillable containers to be assembled into a main product housing without the need for secondary and/or tertiary components attached to the refill container, therefore improving the recyclability and sustainability of the refillable component. These removable containers allow a user to quickly and easily replace a first cosmetic substance with a different cosmetic substance such as, for example, when the first cosmetic substance is used or fully depleted. In other examples, the removable container may allow a user to substitute different cosmetic substances having varying characteristics (e.g., hues, longevity properties, and/or any other features) as desired. Notably, the cosmetic product containers described herein provide for a quick, smooth removal and insertion process of desired removable containers.

Turning to the Figures, a cosmetic product 100 is provided in the form of a jar and/or cannister. Generally, the cosmetic product 100 includes an outer housing 102, a container coupling member 120, and a removable container 140. In some examples, the cosmetic product 100 may additionally include a lid member 150.

The outer housing 102 includes an interior cavity 102*a* that is dimensioned to receive and/or otherwise accommodate at least a portion of the removable container 140. The outer housing 102 further includes a rim 106 that forms an opening 106*a* and may additionally include a container ledge 108 at or near the rim 106. The outer housing 102 may be constructed from any number of suitable materials such as, for example, glass, metal, plastic, or any combination of such materials. In some arrangements and as illustrated in the Figures, the outer housing 102 may be in the form of a cage that includes any number of features that may increase rigidity and/or aesthetic properties of the cosmetic product 100. It is to be appreciated that in other arrangements, the outer housing 102 may take any desired shape and/or form.

The container coupling member 120 is in the form of a ring member 122 defining an interior surface 122*a*. More specifically, in some examples, the ring member 122 may include a first member 124 having a first member ledge 126 and a second member 130 operably coupled therewith. In the illustrated examples, each of the first member 124 and the second member 130 have a generally annular shape. However, other arrangements are possible. In these examples, the interior surface 122*a* is formed on the second member 130. It is to be appreciated that in some examples, the ring member 122 may be in the form of a single, unitary member.

All or portions of the container coupling member 120 may be constructed from a flexible and/or otherwise resilient material. For example, in some arrangements, the container coupling member 120 may be partially or entirely constructed from a plastic material such as, for example, polypropylene (PP), polyethylene (PE), polyethylene terephthalate glycol (PETG), a thermoplastic elastomer (TPE), polyketone (PK), or any other combination of different plastics. In some examples, the first member 124 may be constructed from one or more of PP, PK, or PE, and the second member 130 may be constructed from one or more of PETG, PK, or PE. Such that the first member 124 has a greater rigidity (i.e., less flexibility and/or resilience) than the second member 130. Other arrangements are possible. The container coupling member 120 may be formed via injection molding, bi-injection, and/or overmolding processes to assist with enhancing flexibility thereof.

The first member 124 includes a lower portion 124*a*, the first member ledge 126, and in some examples, an exterior threaded region 128. The second member 130 is operably coupled with the first member 124 and includes a number of support segments 132 that are directed (e.g., extend) inwardly. More specifically, as shown in FIGS. 3-6, the second member 130 is generally inserted into a portion (e.g., a groove or other guiding structure) of the first member 124. In some examples, the first member 124 may be operably coupled with the second member 130 via adhesives, sonic welding, and the like. Other examples are possible.

Figure 3:
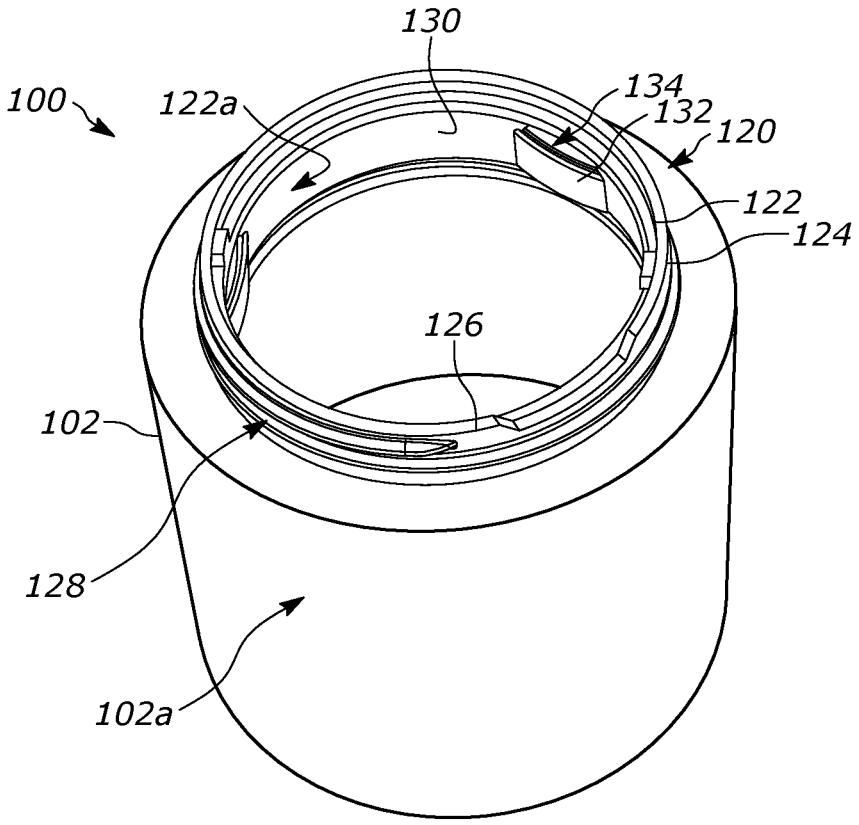
FIG. 3 illustrates an upper perspective view of the example cosmetic product of FIGS. 1 and 2 in accordance with various examples.
Figure 4:
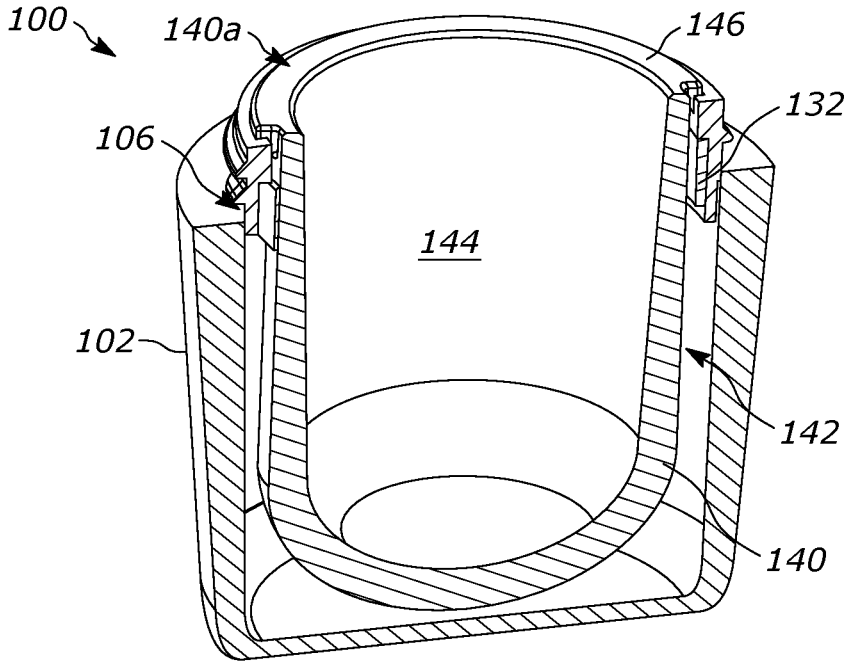
FIG. 4 illustrates a cross-sectional perspective view of the example cosmetic product of FIGS. 1-3 in accordance with various examples.
Figure 5:
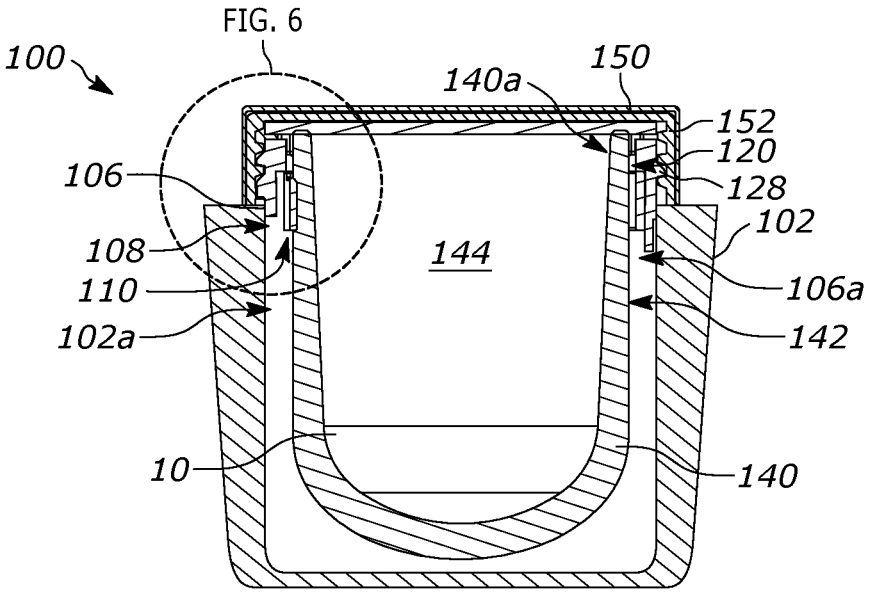
FIG. 5 illustrates a cross-sectional front elevation view of the example cosmetic product of FIGS. 1-4 in accordance with various examples.
Figure 6:
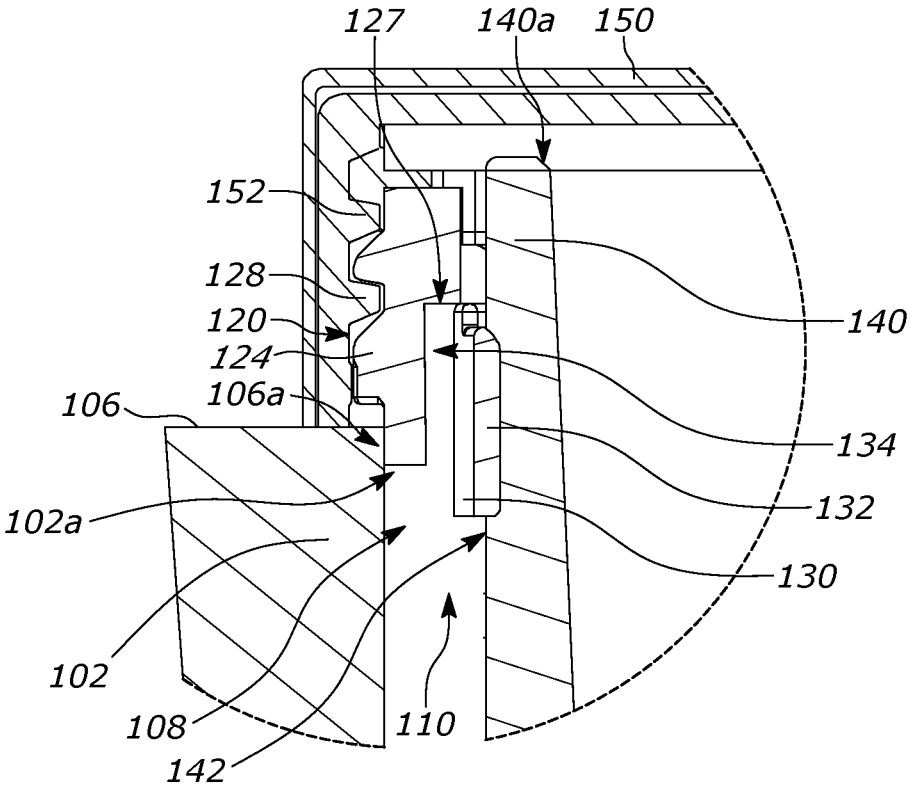
FIG. 6 illustrates a close-up cross-sectional front elevation view of the example cosmetic product of FIGS. 1-5 in accordance with various examples.
Figure 7:
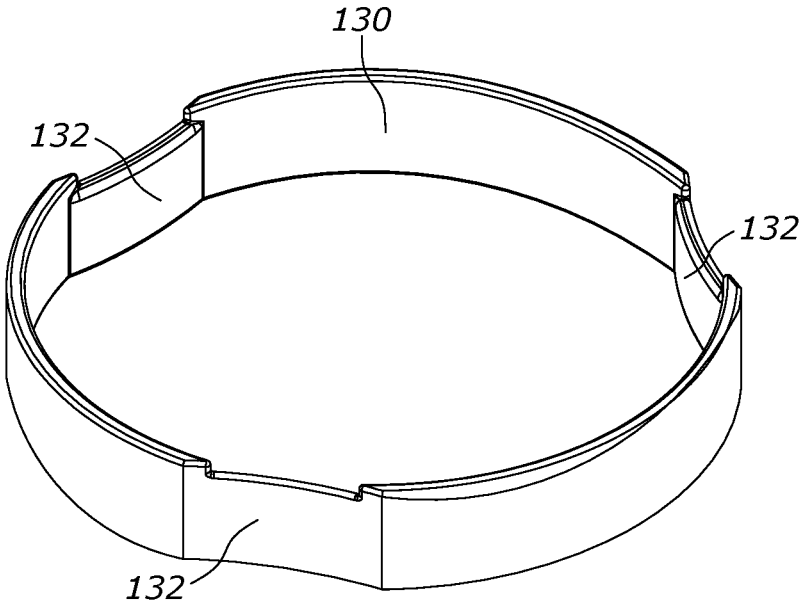
FIG. 7 illustrates a perspective view of a portion of an example container coupling member for use with the example cosmetic product of FIGS. 1-6 in accordance with various examples.
Figure 8:
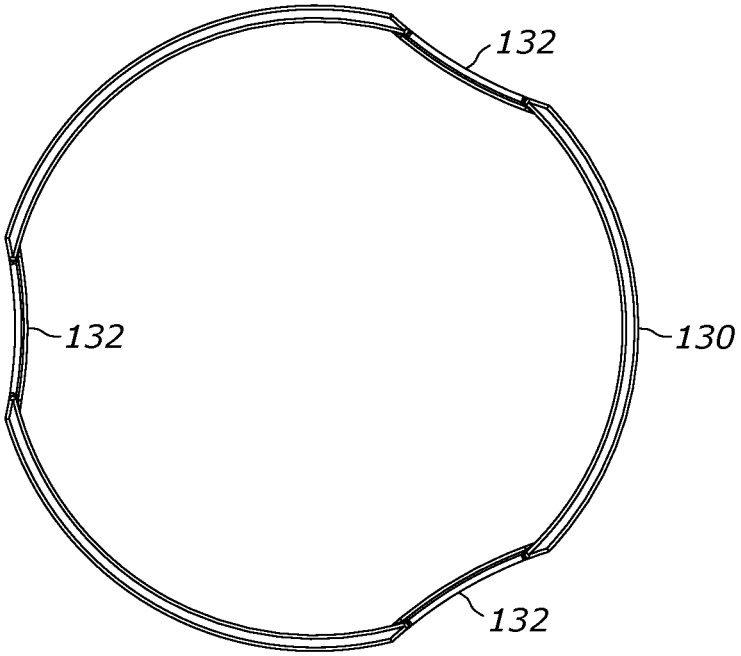
FIG. 8 illustrates a top plan view of the portion of the example container coupling member of FIG. 7 in accordance with various examples.
Figure 9:
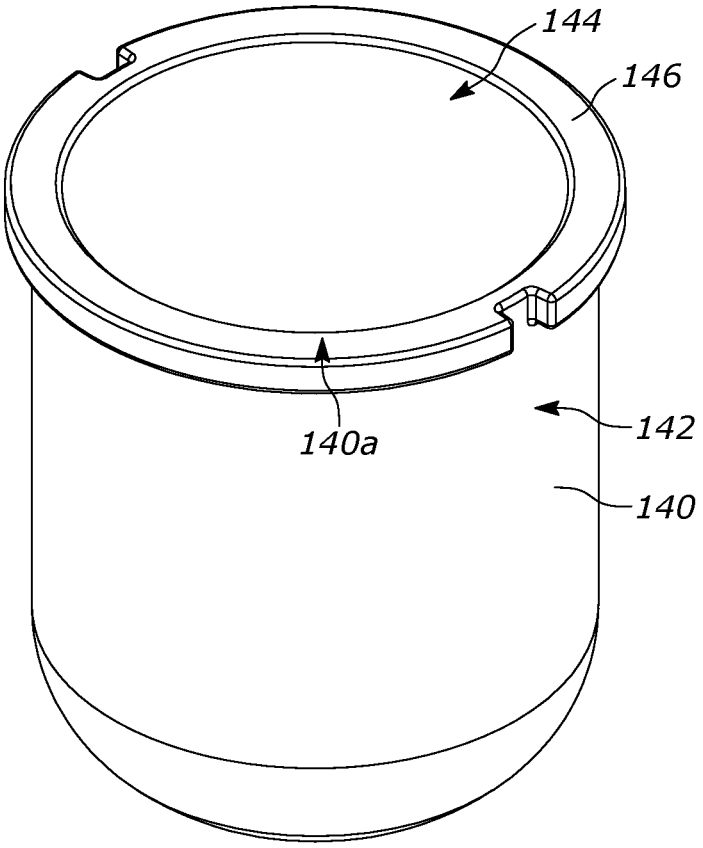
FIG. 9 illustrates a perspective view of an example container for use with the example cosmetic product of FIGS. 1-8 in accordance with various examples.

As previously noted, the second member 130 includes any number of support segments 132. Such support segments 132 extend inwardly towards a central region of the second member 130 when in a resting or otherwise unbiased configuration (i.e., when the removable container 140 is not coupled therewith). The resilience of the support segments 132 (or, in some examples, the second member 130 as a whole) may cause the support segments 132 to bend, deflect, or otherwise be moved outwardly when a force is exerted thereon. Notably, and as illustrated in FIG. 3, when the second member 130 is operably coupled with the first member 124, a gap 134 is formed between an inner surface of the first member 124 and an outer surface of the second member 130 at the support segments 132. Such a gap 134 allows the support segments 132 to displace outwardly when a force is applied thereto.

The removable container 140 includes an outer surface 142, a container cavity 144 for selectively retaining a cosmetic substance 10, and a flange 146 positioned around an opening 140*a* thereof. The removable container 140 may be constructed from any number of suitable materials and/or combinations of materials such as, for example, glass, metals, polymers, and the like. As illustrated in the Figures, in some examples, the removable container 140 may have a generally cup-shaped or otherwise cylindrical body, but other examples of suitable shapes and/or configurations are possible. The removable container 140 may have a generally curved or chamfered transition to enhance comfort when handled by a user.

The removable container 140 may be made using any number of processes and/or approaches. More specifically, in some examples, the removable container 140 may be constructed in a unitary form, and may be dimensioned to accommodate any desired quantity of cosmetic substance 10 (e.g., between approximately 5 ml and approximately 500 ml as desired).

To assemble the cosmetic product 100, the second member 130 of the ring member 122 may be inserted into or otherwise secured with the first member 124. As shown in FIGS. 3-6, the second member 130 abuts an interior support ledge 127 formed on the first member 124. The ring member 122 may then be coupled with the outer housing 102 by positioning the lower portion 124*a* of the first member 124 within the container ledge 108 formed by the rim 106. The ring member 122 may be secured with the outer housing 102 using any suitable approach such as, for example, adhesives, ultrasonic welding, and the like. Other examples are possible.

In some optional approaches, the rim 106 may further include a second ledge 110. This second ledge 110 may accommodate a portion of the second member 130. So arranged, the container ledge 108 and the second ledge 110 may prevent the ring member 122 from moving downwardly into the interior cavity 102*a*, thereby retaining the ring member 122 in a desired position.

In this arrangement, and as shown in FIG. 3, the support segments 132 extend inwardly into the interior cavity 102*a* of the outer housing 102. These support segments 132 have a smaller diameter than a corresponding outer diameter of the removable container 140. As a result, when the removable container 140 is inserted into the interior cavity 102*a* of the outer housing 102 (and thus, into the ring member 122), outer surface 142 of the removable container 140 contacts the support segments 132 and urges them outwardly, thereby decreasing the overall size of the gap 134 formed between the first member 124 and the second member 130. The resilience of the support segments 132 exerts an inward frictional force on the outer surface 142 of the removable container 140 that prevents the removable container 140 from being removed without exerting an ample removal force. The removable container 140 is fully seated within the interior cavity 102*a* when the flange 146 abuts the first member ledge 126, which prevents further insertion of the removable container 140 into the interior cavity 102*a*.

In the illustrated examples, three support segments 132 are provided that are positioned equidistant from each other. Such an arrangement results in the support segments 132 exerting a uniform inward force on the removable container 140. It is to be appreciated that any number of support segments 132 may be provided to modify the force profile exerted on the removable container 140.

The lid member 150 may be in the form of a cap. In the illustrated examples, the lid member 150 includes threads 152 that threadably engage the exterior threaded region 128 of the ring member 122 to secure and retain the cosmetic substance 10 within the container cavity 144. Other examples of coupling arrangements between the lid member 150 and the container coupling member 120 may be provided such as, for example, a hinged coupling, a friction-fit coupling, a magnetic coupling and the like. Other examples are possible. It is to be appreciated that in some examples, the arrangement of the lid member 150 and the threaded region of the first member 124 may be reversed such that the lid member is threadably inserted into a portion of the first member.

As previously noted, the removable container 140 (and thus the cosmetic substance 10) is disposable within, and removable from, the outer housing 102. More specifically, when a user wishes to replace the removable container 140 with a different removable container 140, the user may simply urge the removable container 140 out of the outer housing 102. In the illustrated example, the outer housing 102 includes a number of openings or holes that a user may insert an object (e.g., their finger) into to push the removable container 140 out of the interior cavity 102*a*. A user may then insert a new/different removable container 140 into the outer housing in a similar manner.

The process of replacing or refilling the removable container 140 may be performed in a single step, therefore enhancing usability of the cosmetic product 100. A user may use a single outer housing 102 for varying uses as desired, thereby reducing waste by not disposing of the entire cosmetic product 100. Further, the removable containers described herein do not require additional components to be secured thereto prior to use, therefor reducing costs and manufacturing time while increasing recyclability and sustainability as compared with containers having secondary components constructed from other materials fastened thereto which may require additional steps to remove and replace the container (e.g., screwing secondary components to lock the container in place, etc.).

It is to be appreciated that in some examples (not illustrated), the removable container may have a different shape and/or configuration. For example, the container may be provided in a generally rectangular shape, a generally oval shape, a generally triangular shape, or any other desired shape.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a" "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A cosmetic product comprising:

an outer housing having a rim defining a ledge and forming an opening, the outer housing including an interior cavity;

a container coupling member operably coupled with the rim of the outer housing, the container coupling member including a ring member defining an interior surface, wherein the ledge of the rim is dimensioned to accommodate a portion of the container coupling member to operably couple the container coupling member therewith; and a removable container including an outer surface and a container cavity adapted to retain a cosmetic substance;

wherein the removable container is insertable into the interior cavity of the outer housing such that the interior surface of the ring member frictionally engages the outer surface of the removable container to retain the removable container therewithin.

2. The cosmetic product of claim 1, wherein the ring member is at least partially constructed from a resilient material.

3. The cosmetic product of claim 1, wherein the ring member includes at least one inwardly-directed support segment.

4. The cosmetic product of claim 3, wherein the ring member includes a first member including a ledge and a second member operably coupled therewith, wherein the at least one inwardly-directed support segment is formed on the second member.

5. The cosmetic product of claim 4, wherein the removable container includes a flange adapted to rest on the ledge of the first member of the ring member.

6. The cosmetic product of claim 4, wherein the first member further includes an exterior threaded region.

7. The cosmetic product of claim 4, wherein the ledge is dimensioned to accommodate a lower portion of the first member.

8. The cosmetic product of claim 4, wherein each of the first member and the second member forms a generally annular shape.

9. The cosmetic product of claim 4, wherein the first member is constructed from at least one of polyethylene terephthalate glycol, polyketone, or polypropylene.

10. The cosmetic product of claim 4, wherein the second member is constructed from at least one of polypropylene, polyketone, or polyethylene.

11. The cosmetic product of claim 1, further comprising a lid member adapted to cover the container cavity.

12. A cosmetic product comprising:

an outer housing having a rim defining a ledge and forming an opening, the outer housing including an interior cavity;

a container coupling member operably coupled with the rim of the outer housing, the container coupling member including a ring member defining an interior dimension and including at least one inwardly-directed support segment, a first member including a ledge, and a second member operably coupled therewith, wherein the at least one inwardly-directed support segment is formed on the second member; and a removable container including an outer surface and a container cavity adapted to retain a cosmetic substance, the outer surface defining an exterior dimension that is greater than the interior dimension of the ring member;

wherein the removable container is insertable into the interior cavity of the outer housing such that the ring member frictionally engages the outer surface of the removable container to retain the removable container therewithin.

13. The cosmetic product of claim 12, wherein the ring member is at least partially constructed from a resilient material.

14. The cosmetic product of claim 12, wherein the removable container includes a flange adapted to rest on the ledge of the first member of the ring member.

15. The cosmetic product of claim 12, wherein the first member further includes an exterior threaded region.

16. The cosmetic product of claim 12, wherein the rim of the outer housing defines a ledge dimensioned to accommodate a lower portion of the first member, thereby operably coupling the container coupling member therewith.

17. The cosmetic product of claim 12, wherein each of the first member and the second member forms a generally annular shape.

* * * * *